US006010314A

United States Patent [19]

Kobayashi et al.

[11] Patent Number: 6,010,314

[45] Date of Patent: Jan. 4, 2000

[54] SWASH-PLATE COMPRESSOR HAVING A CAPACITY CONTROL VALVE ON THE OIL RETURN PASSAGEWAY ADJACENT AN OIL SEPARATOR

[75] Inventors: Hisakazu Kobayashi; Masaru Hamasaki; Masayoshi Hori; Masaki Ota, all of Kariya, Japan

[73] Assignee: Kabushiki Kaisha Toyoda Jidoshokki Seisakusho, Kariya, Japan

[21] Appl. No.: 09/002,757

[22] Filed: Jan. 5, 1998

[30] Foreign Application Priority Data

Jan. 10, 1997 [JP] Japan ..... 9-003036

[51] Int. Cl.[7] ..... F04B 1/26

[52] U.S. Cl. ..... 417/222.2; 417/269; 417/313

[58] Field of Search ..... 417/269, 222.2, 417/312

[56] References Cited

U.S. PATENT DOCUMENTS

| | | | |
|---|---|---|---|
| 4,815,943 | 3/1989 | Kawashima et al. . | |
| 5,332,872 | 7/1994 | Ewanek . | |
| 5,580,224 | 12/1996 | Ikeda et al. | 417/269 |
| 5,636,974 | 6/1997 | Ikeda et al. | 417/269 |
| 5,699,716 | 12/1997 | Ota et al. | 92/12.2 |
| 5,752,809 | 5/1998 | Makino et al. | 417/269 |
| 5,823,294 | 10/1998 | Mizutani et al. | 184/6.3 |
| 5,871,337 | 2/1999 | Fukanuma et al. | 417/222.2 |

FOREIGN PATENT DOCUMENTS

| | | |
|---|---|---|
| 714192 | 11/1931 | France . |
| 2609970 | 9/1976 | Germany . |
| 19520267 | 12/1995 | Germany . |
| 19610437 | 10/1996 | Germany . |
| 19723628 | 12/1997 | Germany . |
| 08035485 | 2/1996 | Japan . |
| 08114182 | 5/1996 | Japan . |

OTHER PUBLICATIONS

German Office Action issued for the corresponding application in Germany, and its English translation thereof.

*Primary Examiner*—Timothy S. Thorpe
*Assistant Examiner*—Ehud Gartenberg
*Attorney, Agent, or Firm*—Burgess, Ryan & Wayne

[57] ABSTRACT

A compressor having an oil separator at a shell portion of a housing of the compressor. The oil separator is constructed by a front part 61 integral to a front housing 11 and a rear part 62 integral to a cylinder block 12. The oil separator has an oil separation chamber 1 formed between the front and the rear parts 61 and 62. The oil separator is formed integrally with oil separating passageway forming plates 67 and 68 which partially divide the separation chamber 63 to create a serpentine shaped passageway 66 which extends from an inlet 64*a* to an outlet 65 of the separation chamber. The passageway 66 is in communication with the crank chamber 15 via a oil return passageway 69 at a location adjacent its outlet.

3 Claims, 5 Drawing Sheets

SWASH-PLATE COMPRESSOR HAVING A CAPACITY CONTROL VALVE ON THE OIL RETURN PASSAGEWAY ADJACENT AN OIL SEPARATOR

BACKGROUND OF THE INVENTION

1. Field of the Invention

The present invention relates to a compressor which, for example, can be utilized in an air conditioning system for a vehicle.

2. Description of Related Art

In a known compressor, which can be utilized in an air conditioning system for a vehicle having a housing, a crank chamber is formed for storing therein a driving mechanism for operating a piston stored in a cylinder bore. Namely, under the action of the driving mechanism, an axial reciprocating movement is imparted to the piston, thereby executing a compression cycle, which consists of a series of operating periods, which includes a sucking of a refrigerant gas as a fluid to be subjected to a compression, a compression of the sucked gas and a discharge of the compressed refrigerant gas to an outside refrigerant system.

In the above mentioned compressor, lubrication of parts subjected to sliding movements relies on a flow of lubricant into the compressor together with the flow of the refrigerant gas. In other words, the lubricant is mixed with the refrigerant gas to be compressed. As a result, the discharge of the compressed gas to the outside refrigerant system causes the lubricant mixed therewith to be discharged, which causes the amount of the lubricant to be reduced, thereby causing the lubrication to be insufficient.

Furthermore, a change in the capacity in the above mentioned type of the compressor is, for example, done by adjusting the pressure at the crank chamber. Namely, a change of the pressure at the crank chamber causes a pressure difference to vary between the crank chamber and the cylinder bore. On the other hand, a shortage of the lubricant in the compressor causes an excessive heat to be generated at the sliding parts in the compressor, which causes the pressure to be increased at the crank chamber. Such an increase in the pressure at the crank chamber causes the capacity to be reduced. In short, a stable control of the capacity cannot be done.

SUMMARY OF THE INVENTION

An object of the present invention is to provide a compressor capable of overcoming the above mentioned difficulty in the prior art.

Another object of the present invention is to provide a compressor capable of reducing the amount of the lubricant discharged to the outside refrigerant system.

According to the present invention, a compressor is provided which comprises:

a housing comprising a plurality of housing members which are in connection with each other for creating a crank chamber;

an operating means in the crank chamber for causing a refrigerant gas to be sucked, compressed and discharged, and;

oil separators formed integrally at the outer portions of the housing members, respectively, which are located adjacent to and in contact with each other in such a manner that an inner space in at least one of the oil separators is closed by the other oil separator so that a separation chamber for the discharged refrigerant gas is created;

said oil separator being integrally formed with passageway forming members, so that the separation chamber is partially divided in such a manner that, from an inlet to an outlet of the separation chamber, a serpentine separation passageway for the discharged refrigerant gas is formed, while said separation chamber is in communication with the crank chamber via a oil return passageway.

In this invention, the discharged refrigerant gas introduced into the separation chamber flows from the inlet to the outlet while being guided by the separation passageway, where a zigzag flow of the refrigerant gas is obtained, thereby increasing a chance of contact of the refrigerant gas with the inner wall of the passage forming part and the oil separation part, which allows a large amount of the lubricant to be separated from the refrigerant gas. The separated lubricant in the separation chamber is returned to the crank chamber by way of the oil return passageway.

Preferably, said housing is formed with a cylinder bore, to which a piston is slidably accommodated, said operating means comprise a drive shaft rotatably supported on the housing and a cam plate which is arranged in the crank chamber and supported to the drive shaft while a degree of an inclination of the cam plate with respect to an axis of the drive shaft is adjusted, so that an amount of the stroke of the piston is varied, thereby allowing the capacity to be varied. In this construction, the rotating movement of the drive shaft is transformed to a reciprocating straight movement of the piston via the cam plate, so that a series of compression cycles is attained, each consisting of a sucking of the refrigerant gas into the cylinder bore, which is followed by a compression and a discharge of the sucked refrigerant gas. Furthermore, an adjustment of the inclined angle of the cam plate allows a piston stroke to be varied, thereby changing the capacity of the compressor.

According to the present invention, an effective separation of the lubricant from the discharged refrigerant gas in the separation chamber is obtained, so that the separated lubricant is effectively returned to the crank chamber. Thus, an increased amount of the lubricant is maintained in the compressor without being discharged to the outside refrigerant pipe, which allows a desired lubrication to be executed at various locations of the compressor where a sliding movement occurs and which otherwise causes the cooling capacity of the air conditioning system to be reduced.

Preferably, the separation chamber functions as a muffler for reducing the pressure pulsation of the discharged refrigerant gas. Due to the function of the separation chamber as a muffler, a pressure pulsation of the refrigerant gas passed through the separation chamber can be suppressed. As a result, the reduction of the pressure pulsation is obtained, thereby reducing the vibration as well as an operating noise.

Preferably, said separation passageway is opened to the separation chamber at a location adjacent to an outlet of the separation chamber. As a result of this structure, the separated lubricant is, under a pressure difference in the separation chamber, moved to the outlet side of a reduced pressure. Thus, an increased amount of the lubricant returned to the crank chamber via the oil return passageway is obtained.

Preferably, in order to adjust the capacity, the pressure at the crank chamber is changed so that the pressure difference is changed between the crank chamber and the cylinder bore between which the piston is located, and a capacity control valve is located on the oil return passageway connecting the crank chamber with the oil separation chamber, so that the pressure at the crank chamber is adjusted by the degree of the opening of the return passageway being adjusted by the capacity control valve.

In an operation of the capacity control valve which reduces the degree of opening of the oil return passageway, the pressure at the crank chamber is reduced. Thus, the pressure difference between the crank chamber and the cylinder bore, between which the piston is arranged, causes the cam plate to be moved toward the maximum inclined position, thereby increasing the capacity. Contrary to this, in an operation of the capacity control valve to increase the degree of the opening of the oil return passageway, the pressure at the crank chamber is increased, which causes the cam plate to be moved toward the minimum inclined position, thereby reducing the capacity.

During the operation at a condition near the minimum capacity, the amount of the recirculated refrigerant is reduced, which may cause lubrication to be lacking at portions of the compressor where a sliding movement occurs. However, an operation of the capacity control valve for increasing the degree of the opening of the oil return passageway is obtained, which causes a large amount of lubricant, together with the discharged refrigerant gas, to flows into the crank chamber from the separation chamber. Thus, any lack of lubrication during the operation near the minimum capacity condition does not occur.

As a result, during an operation near the minimum capacity condition of reduced recirculated amount of the refrigerant, an increased amount of the lubricant can be returned to the crank chamber, thereby preventing a lack of the lubricant at the parts where a sliding movement occurs during the reduced capacity operation of the compressor.

BRIEF EXPLANATION OF ATTACHED DRAWINGS

DETAILED DESCRIPTION OF PREFERRED EMBODIMENTS

Now, embodiments of the present invention will be explained with reference to attached drawings.

Figure 1:
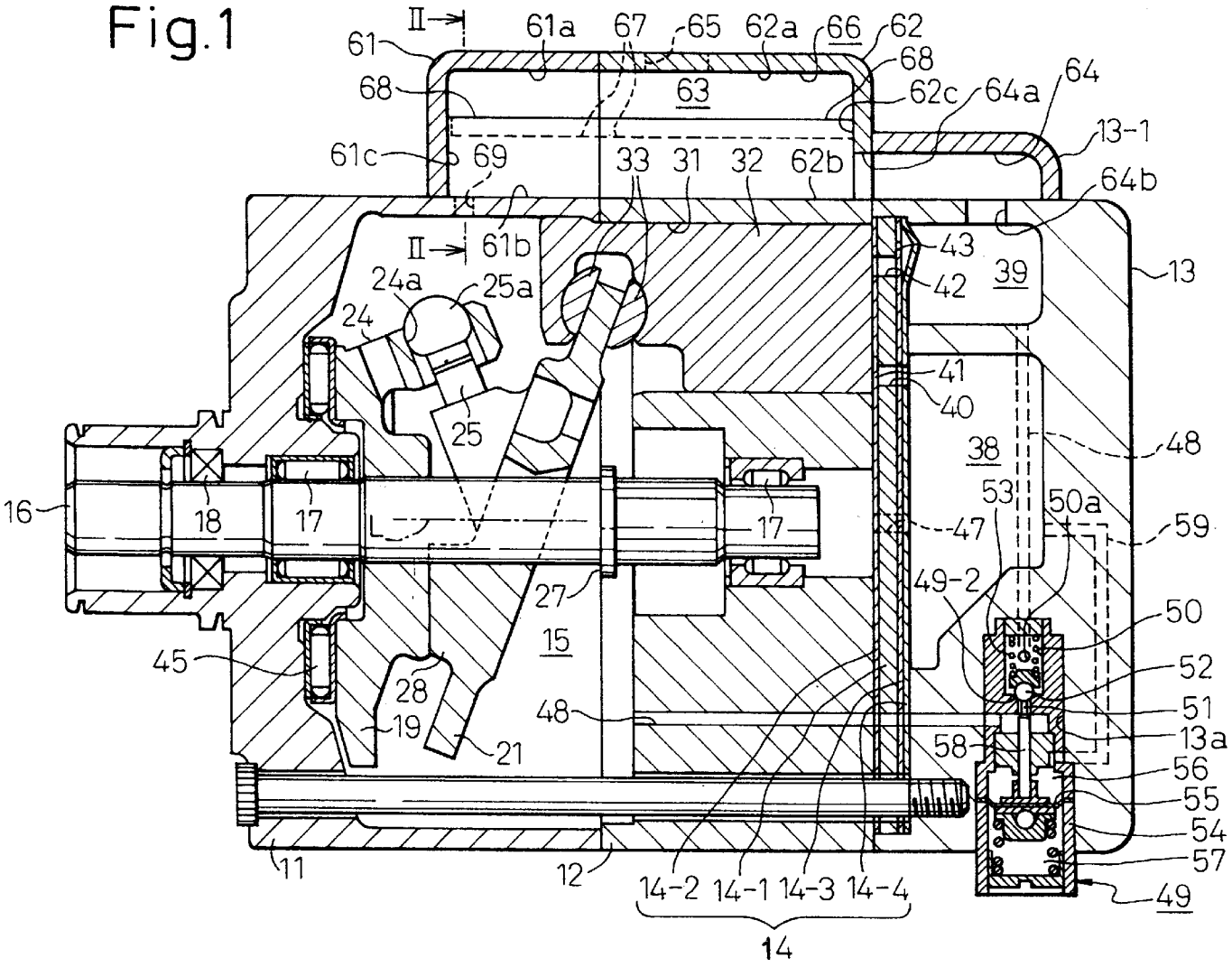
FIG. 1 is a longitudinal cross sectional view of the variable displacement type compressor according to the first embodiment of the present invention.

In the first embodiment shown FIG. 1, the compressor includes a housing structure including a front housing 11, a cylinder block 12, a rear housing 13 and a valve assembly 14. The cylinder block 12 has a front end, to which the front housing 11 is connected and a rear end, to which the rear housing 13 is connected via the valve assembly 14. A crank chamber 15 is formed between the front housing 11 and the cylinder block 12.

A drive shaft 16 extends axially through the crank chamber 15. The drive shaft 16 is, at is front and rear ends, rotatably supported to the front housing 11 and the cylinder block 12, respectively via respective radial bearing units 17. In a well known manner, the drive shaft 16 is connected, via a clutch mechanism such as an electromagnetic clutch, to a rotating shaft of a vehicle engine as a rotating movement source. As a result, an engagement of the electromagnetic clutch causes the rotating movement of the engine to be transmitted to the drive shaft 16 of the compressor, thereby executing a compression operation.

A lip seal unit 18 is arranged inside the front housing 11 so that the seal unit 18 is, at its inner surface, contacted with an outer periphery of the drive shaft 16. As a result, a sealed connection is realized between the front housing 11 and the drive shaft 16.

A supporting member 19 is arranged in the crank chamber 15 and is fixedly connected to the rotating shaft 16 by a suitable means. A swash plate 21 as a cam plate constructing a drive mechanism is mounted to the drive shaft 16 in such a manner that the swash plate 21 is, with respect to the drive shaft 16, axially movable in a direction of axis L and is tilted. The supporting member 19 is, at its outer peripheral parts, formed integrally with supporting arms 24, which extend rearwardly toward the swash plate 21. On the other hand, the swash plate 21 is, at its front side, integrally formed with guide pins 25 having, at their tip ends, spherical portions 25*a,* which are slidably received by respective guide holes 24*a* formed in the respective arms 24. Due to this structure, where the supporting member 19 is connected to the swash plate 21 via the supporting arms 24 and the guide pins 25, the rotating movement of the drive shaft 16, i.e., the rotating movement of the support member 19 is transmitted to the swash plate 21. Furthermore, due to a slidable connection of the spherical parts 25*a* to the guide holes 24*a* in the arms 24, a possibility of a tilting movement of the swash plate 21 with the respect to the drive shaft 16 is maintained. Namely, a reduction of the tilting angle is obtained when the swash plate 21 is, at its radially inner part, located to be nearer to the cylinder block 12.

A ring shaped stopper member 27 is fixed to the drive shaft 16 at a location between the swash plate 21 and the cylinder block 12. Thus, the maximum tilting angle of the swash plate 21 is obtained by bringing the swash plate 21 into contact with the stopper member 27.

The cylinder block 12 is formed with cylinder bores 31 so that they extend axially through the cylinder block 12. Single headed pistons 32 are axially slidably inserted in the respective cylinder bores 31. The pistons 32 are at their front ends slidably engaged with the swash plate 21 at its outer peripheral portion via shoes 33. As a result, the rotating movement of the swash plate 21 causes the pistons 32 to be axially reciprocated in the respective cylinder bores 31.

The rear housing 13 is formed with inner and outer recesses which cooperate with the valve assembly 14 so that an intake chamber 38 and an exhaust chamber 39 are created between the housing 13 and the valve assembly 14.

The valve assembly 14 comprises a base plate 14-1, an intake valve plate 14-2 on one side of the base plate adjacent the pistons 32, an exhaust valve plate 14-3 on the other side of the base plate remote from the pistons 32 and a retainer plate 14-4 located between the exhaust valve plate and the rear housing 13. The intake valve plate 14-2 forms intake valves 41, as reed valves, for admission of the refrigerant to be subjected to compression into the corresponding cylinder bores 31 from the intake chamber 38 via corresponding intake ports 40 in the base plate 14-1 when the corresponding pistons 32 are moved in a forward direction (left-handed direction in FIG. 1). The exhaust valve plate 14-3 forms exhaust valves 43, as reed valves, for discharge of the compressed refrigerant into the exhaust chamber 39 from the corresponding cylinder bores 31, via corresponding exhaust ports 42 in the base plate 14-1, when the corresponding pistons 32 are moved in a rearward direction (right-handed direction in FIG. 1). Finally, the retainer 14-4 is for limiting the degree of the opening of exhaust valves 43.

As shown FIG. 1, a thrust bearing 45 is arranged between the supporting member 19 and an inner wall of the front housing 11. The thrust bearing functions to receive a thrust force from the supporting member 19 as a compression reaction force generated in the pistons 32 and transmitted to the supporting member 19 via the swash plate 2.

A gas sucking passageway 47 is formed in the valve assembly 14 in such a manner that the crank chamber 15 is connected with the intake chamber 38 via a gap in the bearing unit 17. A gas feed passageway 48 is formed in the cylinder block 12, the valve assembly 14 and the rear housing 13 in such a manner that the crank chamber 15 is connected with the exhaust chamber 39 via a capacity control valve 49.

The construction of the capacity control valve 49 is now explained. The capacity control valve 49 includes a tubular body 54 inserted into a bore 13*a* in the rear housing 13, so that a valve chamber 50 is formed inside the upper part of the tubular body 54. The tubular body is formed with a valve port 51 opened to the valve chamber 50. A valve member 52 of a spherical shape is arranged in the valve chamber 50, while a spring 53 urges the valve member 52 so that the valve member 52 is rested on a valve seat 49-2. A diaphragm 55 is arranged across a space inside the tubular body 54, so that the diaphragm chamber is divided into a pressure sensitive chamber 56 located above the diaphragm 55 and an air chamber located below the diaphragm 55 and opened to the atmosphere. An operating rod 58 has a bottom end which is connected to the diaphragm 55 and a top end associated with the valve member 52. The rear housing 13 is formed with a pressure sensitive passageway 59 having a first end opened to the intake chamber 38 and a second end opened to the pressure sensitive chamber 56. As a result, the refrigerant gas in the intake chamber 38 is introduced into the pressure sensitive chamber 56.

In an operation of the capacity control valve 49, a displacement of the diaphragm 55 is varied in accordance with a pressure of the refrigerant at the pressure sensitive chamber 56 opened to the intake chamber 38, so that a degree of opening of the feed passageway 48 is varied, which causes the pressure to be varied at the crank chamber 15. As a result, the pressure difference is varied between the crank chamber 15 and the cylinder bores 31, which causes the tilting angle of the swash plate 21 to be varied, which causes a stroke of the pistons 32 to be varied, thereby adjusting the discharged amount. In more detail, an increased air conditioning load causes the diaphragm 55 to be moved downwardly, thereby reducing the degree of the opening of the port 51, i.e., an effective area of the feed passageway 48. As result, a discharge of the gas at the crank chamber 15 via the gas sucking passageway 47 occurs, thereby reducing the pressure at the crank chamber 15. As a result, the tilting angle of the swash plate 21 is increased, which causes an amount of the stroke of the pistons 32 to be increased, thereby increasing the discharged amount, resulting in a reduction of the intake pressure.

Contrary to this, a reduced air conditioning load causes the diaphragm 55 to be moved upwardly, thereby increasing an effective area of the feed passageway 48. As result, the gas of a high pressure from the exhaust chamber 39 is introduced into the crank chamber 15 via the gas sucking passageway 47, thereby increasing the pressure at the crank chamber 15. As a result, the tilting angle of the swash plate 21 is reduced, which causes an amount of a stroke of the pistons 32 to be reduced, thereby reducing the discharged amount, resulting in an increase in the intake pressure. In short, the capacity control valve 49 adjusts the discharged amount by adjusting a tilting angle of the swash plate 21, thereby keeping a predetermined value of the intake pressure.

Figure 2:
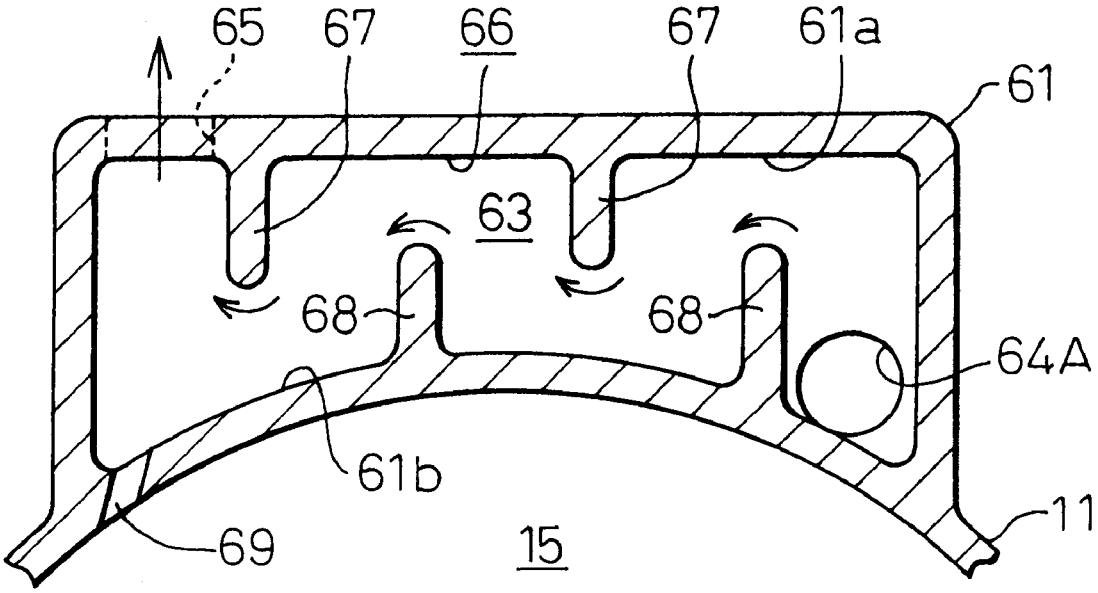
FIG. 2 is a cross-sectional view taken along a line II—II in FIG. 1.

According to the present invention, as shown in FIGS. 1 and 2, the front housing 11 is, at its outer cylindrical wall, integrally formed with a front oil separator part 61, while the cylinder block 12 is, at its outer cylindrical wall, integrally formed with a rear oil separator part 62. The front and rear oil separator parts 61 and 62 are in an axially end to end contacted condition, so that a closed separator chamber 63 is formed inside the parts 61 and 62. The rear housing 13 is, at its outer part, formed with a connecting piece 13-1, in which a communication passageway 64 is formed, which, on one hand, is connected to the separation chamber 63 via an opening 64*a* in the rear separator part 62 and is connected to the exhaust chamber 39 via an opening 64*b* in the rear chamber 13, on the other hand. The opening 64*a* functions as an inlet to the separation chamber 63. As shown in FIG. 2, the rear separator part 62 is, at its top wall, formed with a discharge port 65, so that the latter is opened to the separation chamber 63. The outlet port 65 functions as an outlet of the separation chamber 63. As shown in FIG. 2, the opening 64*a* of the communication passageway 64 and the discharge port 65 are spaced along the circumferenctial direction of the housing. In a well known manner, the intake chamber 38 is connected to an outside refrigerating system (not shown) at a location downstream from an evaporator (not shown). The discharge port 65 is connected to the outside refrigerating system at a location upstream from a condenser (not shown).

Furthermore, according to present invention, a separation passageway 66 is formed inside the separation chamber 63 in such a manner that the discharged refrigerant flowing into the separation chamber 63 via the communication passageway 64 is, after being guided through the separation passageway 63, directed to the discharge port 65. In more detail, as shown in FIG. 2, two upper passageway forming plates 67 are formed integrally in the oil separating parts 61 and 62 at their inner top surfaces 61*a* and 62*a*, respectively at a predetermined spacing. Similarly, two lower passageway forming plates 68 are formed integrally in the oil separating parts 61 and 62 at their inner bottom surfaces 61*b* and 62*b*, respectively at a predetermined spacing. In each of the oil separation parts 61 and 62, each of the passageway forming plates 67 and 68 extends in the direction of the axis of the compressor from an inner end surface to an open end of the corresponding oil separation part. As shown in FIG. 2, the upper passageway forming plates 67 and the lower passageway forming plates 68 are arranged at a spaced relationship along a circumference of the housings 11 to 13 in such a manner that a tip end of a passage forming plate extends to a space between passage forming plates extending from an opposite surface. As a result, a labyrinth structure, in the inner space of the oil separation parts 61 and 62, is created.

Furthermore, when the front and rear oil separation parts 61 and 62 are in an end-to-end assembled condition as shown in FIG. 1, the upper passageway forming plates 67 in the front and rear oil separation parts 61 and 62 are connected with each other along a straight line. Similarly, a straight connection is also obtained to the lower passageway forming plates 68 of the front and rear oil separation parts 61 and 62. As a result, the upper and lower passageway forming parts 67 and 68 function to partially section the oil separation space 63, so that a separation passageway 66 is formed in the separation space 63, so that a serpentine flow of the discharged refrigerant between the inlet opening 64*a* and the outlet opening 65 is obtained in the space 63, as shown by the arrows in FIG. 2. In other words, the refrigerant flowing into the separation space 63 via the communication passageway 64 is subjected to an alternating change in flow direction, between an upward direction and a downward direction, created due to the fact that the gas flows or is guided along the separation passageway 66, i.e., along a periphery of the housings 11 to 13.

The front housing 11 is formed with an oil return passageway 69, therethrough, which has a first end opened to the crank chamber 15 and a second end opened to the separation chamber 63 at a location located adjacent to the outlet port 65.

An operation of the compressor according to present invention will be explained. When the clutch is engaged, a rotating movement from the internal combustion engine as an outside rotating movement source is transmitted to the drive shaft 16 of the compressor, so that the rotating movement is transformed into an axial reciprocating movement of the pistons 32. During the reciprocating movement, when the piston 32 is moved away from the rear housing 13, i.e., moved in a left-handed direction in FIG. 1, the refrigerant in the intake chamber 38 is sucked into the cylinder bores 31 via the respective intake ports 40 and the intake valves 41. When the piston 32 is moved toward the rear housing 13, i.e., moved in a right-handed direction in FIG. 1, the compressed refrigerant in the cylinder bore 31 is discharged into the outlet chamber 39 via the respective outlet ports 42 and the outlet valves 43. As a result, the compression cycle of the refrigerant gas is executed.

The refrigerant gas discharged into the outlet chamber 39 is sucked, via the communication passageway 64, into the separation chamber 63. The refrigerant gas flowing into the separation chamber 63 is guided through the separation passageway 66 and reaches the outlet port 65, from which the refrigerant gas is discharged into the outside refrigerant system.

In the above operation of the compressor according to the present invention, due to the provision of the separation passageway 66, a zigzag flow of the refrigerant in the separation chamber 63 is realized. In other words, the flow of the refrigerant is subjected to an alternating directional change between upward and downward directions. When such a change in the flow direction occurs, the refrigerant gas is effectively contacted with the inner surfaces of the oil separation parts 61 and 62 and the passageway forming plates 67 and 68, thereby increasing the amount of the lubricant separated from the discharged refrigerant gas from the outlet chamber 39.

The lubricant separated from the discharged refrigerant gas is, under the local pressure difference in the separation chamber 63, moved to the outlet port 65. In this case, a situation may arise that a part of the lubricant remains between two lower passageway forming plates 68. However, a provision of means such as holes in the lower passageway forming plate 68 located adjacent the outlet port 65 allows the separated lubricant to be positively directed to the oil return passageway 69. Furthermore, the lubricant separated at the space 63 flows into the crank chamber 15 via the oil return passageway 69. Namely, the lubricant in the compressor is flown together with the discharged refrigerant and tends to be discharged to the outside refrigerant system. However, from the discharged refrigerant passed through the separation space 63, a large amount of the lubricant is separated and is returned to the crank chamber 15, so that the amount of the lubricant discharged to the outside refrigerant passageway is reduced.

Furthermore, the separation space 63 of a desired volume functions as an expansion type muffler, which, in cooperation with the function of the separation passageway 66, which causes the discharged gas to flow in a serpentine path, serves to effectively reduce the pressure pulsation in the discharged refrigerant gas.

In the above first embodiment, following advantageous effects are obtained.

First, the lubricant flowing to the outside refrigerating system together with the discharged refrigerant gas is separated therefrom at the separating chamber 63. The lubricant separated from the discharged refrigerant gas is returned, from the separation chamber 63, to the crank chamber 15, thereby maintaining a desired amount of the lubricant in the crank chamber 15. As a result, the compressor does not lack in lubrication, i.e., a desired lubrication of the various parts subjected to a sliding movement in the compressor is obtained. A reduction in the cooling capacity in the air conditioning system is prevented, due to the fact that it is possible to prevent an increased amount of a discharged lubricant moving to the outside refrigerating system, which would otherwise cause the lubricant to be likely attached to the inner surface of the refrigerant evaporate and causes the heat exchanging capacity to be reduced.

Second, the separation passageway 66 is formed inside the separation space 63, which causes the flow passageway of the discharged refrigerant to be formed as a serpentine path, which serves the lubricant to be efficiently separated from the discharged refrigerant.

Furthermore, the oil separation chamber 63 is formed by connecting the oil separation parts 61 and 62 with each other so the spaces inside the parts 61 and 62 are integrated, while the both of the oil separation parts 61 and 62 are formed integrally in the front housing 11 and the cylinder block 12, respectively. In other words, in order to form the separating chamber 63, no member other than the front housing 11 and the cylinder block 12 is needed. Thus, a reduction in number of parts for constructing the compressor is obtained.

The serpentine shaped separation passageway 66 is formed by dividing the separation space 63 by means of the passageway forming plates 67 and 68 integrally formed to the oil separation parts 61 and 62, respectively. In other words, in order to form the separation passageway 66 in the separation space 63, no member is needed other than the oil separation parts 61 and 62, i.e., the front housing 11 and the cylinder block 12, thereby reducing the number of parts constructing the compressor.

Furthermore, the above compressor is of variable displacement type capable of controlling an outlet capacity and the change in the outlet capacity is done by controlling the pressure at the crank chamber 15. Thus, an increase in the pressure at the crank chamber 15 due to heat excessively generated at the sliding parts in the compressor causes the outlet capacity to be unexpectedly reduced. However, according to the present invention, a lack of lubricant in the compressor is less likely, i.e., an unexpected increase in the pressure at the crank chamber is prevented, thereby maintaining a stable capacity control of the compressor.

Furthermore, the separation chamber 63 functions as a muffler, which functions to reduce pressure pulsations in the refrigerant discharged to the outside refrigerating system. Thus, a reduction in vibration as well as in noise, caused by the pressure pulsations can be reduced.

Finally, the lubricant separated at the separation space 63 is moved to a location adjacent the outlet port 65 as a low pressure side. Since the oil return passageway 69 is located adjacent the outlet port 65, the major part of the lubricant separated in the separation chamber 63 is returned to the crank chamber 15.

Figure 3:
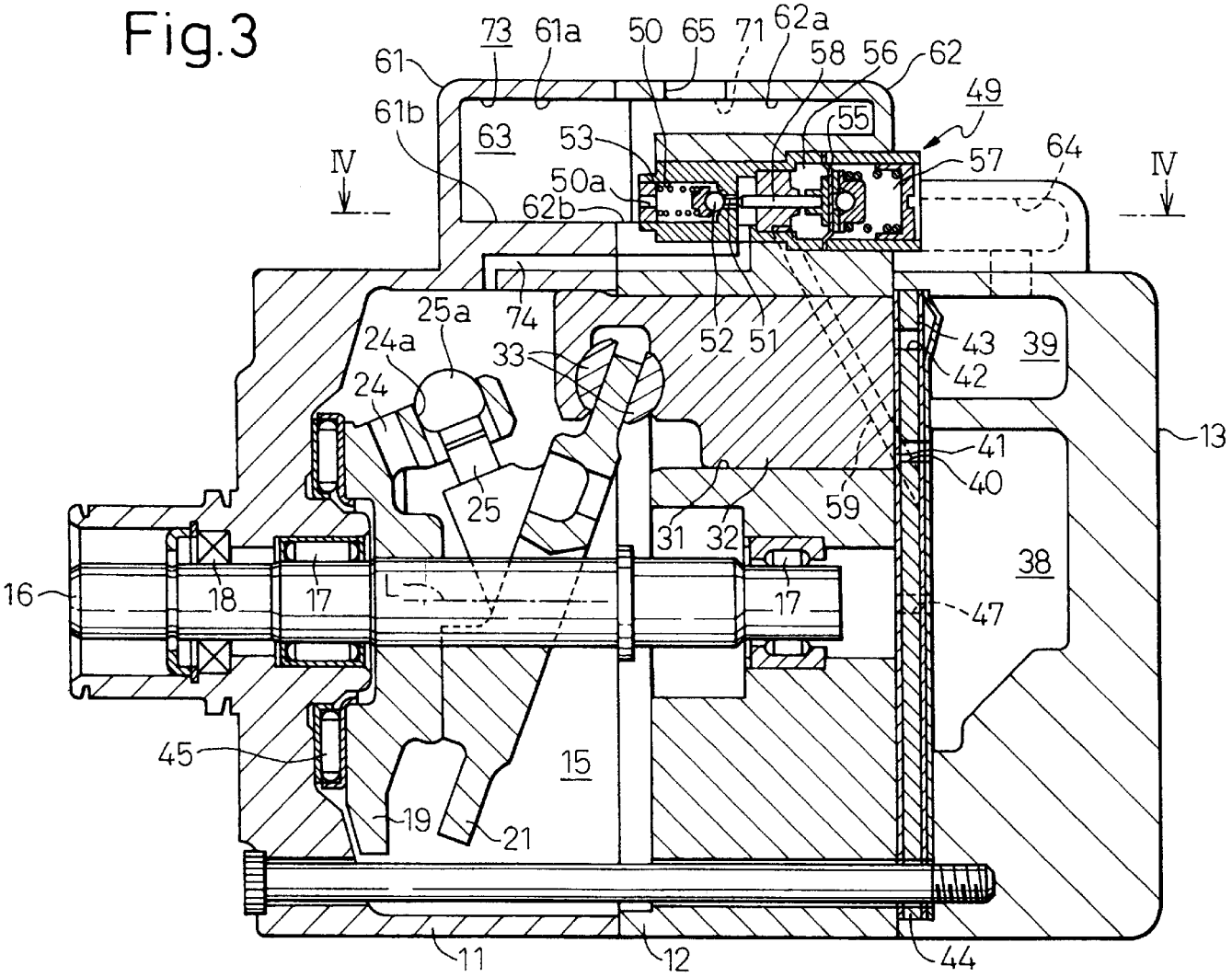
FIG. 3 is a longitudinal cross sectional view of the variable displacement type compressor according to the second embodiment of the present invention.
Figure 4:
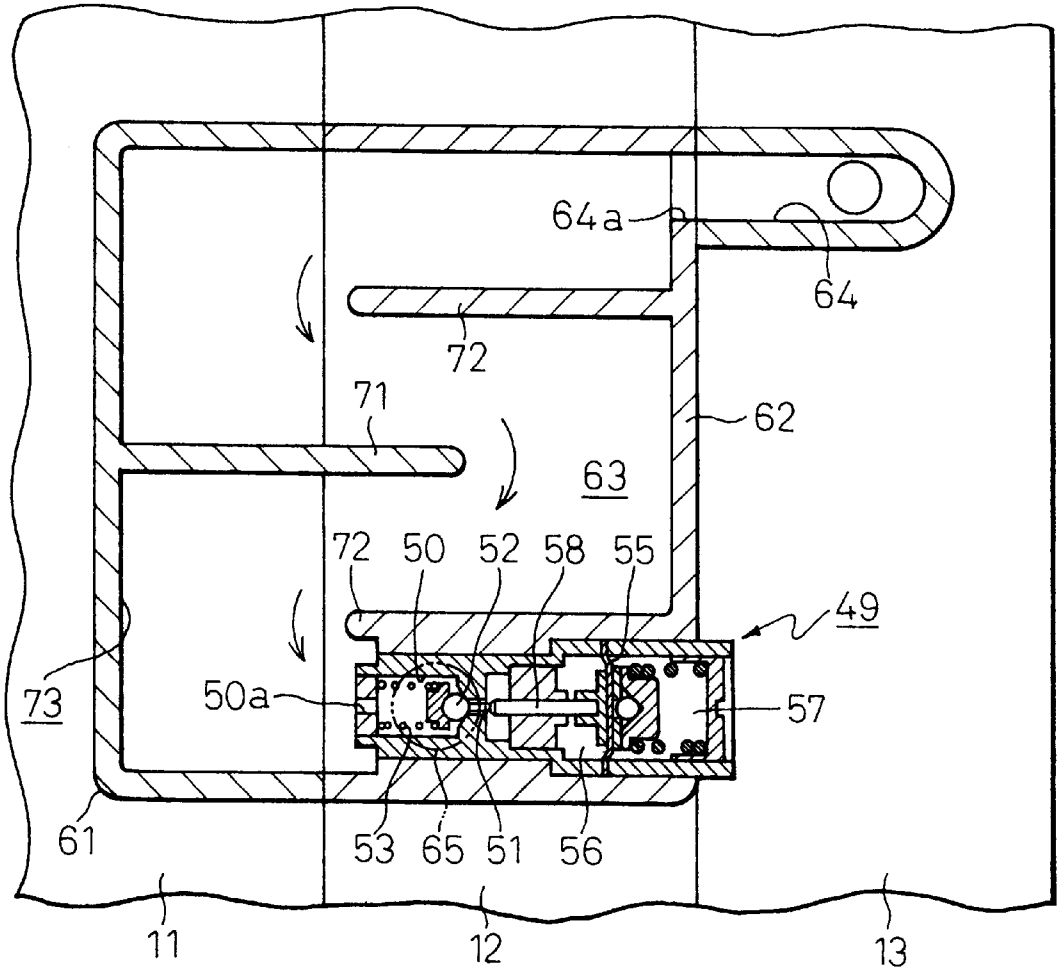
FIG. 4 is a cross sectional view taken along a line IV—IV in FIG. 3.

In a second embodiment of the present invention shown in FIGS. 3 and 4, a front passageway forming plate 72 is formed integrally on the inner surface of the front oil separation part 61, while two rear passageway forming plates 72 are formed integrally on the inner surface of the rear oil separation part 62. In the combined condition of the oil separation parts 61 and 62 as shown in FIG. 4, the front passageway forming plate 71 and the rear passageway forming plate 72 are, at their tip ends, projected partly to spaces on the sides of opposite plates, so that a oil separating chamber 63 is partially sectioned, thereby forming, in the chamber 63, an oil separation passageway 73 for obtaining a flow of the refrigerant gas in a serpentine path.

As a result of this structure, the refrigerant gas introduced, via the communication passageway 64, into the oil separation chamber 63 is subjected to a guiding operation by the separation passageway 73 in such a manner that the refrigerant gas flows toward the discharge outlet 65 along the axial direction L of the compressor while the direction of the flow of the refrigerant is alternately changed in the direction transverse to the direction L. As a result, an oil separating function as explained with reference to the first embodiment is obtained, so that separation of the lubricant from the gaseous refrigerant flowing in the separation chamber 63 occurs and the separated lubricant is moved toward a location adjacent the discharge port 65.

According to this embodiment, the capacity control valve 49 is arranged at the rear oil separation part 62 in such a manner that a high pressure taking out port 50*a* of the valve chamber 50 constructing a gas feed passageway 74 is opened to the separation chamber 63 at a location adjacent to the discharge port 65. Thus, the lubricant separated at the separation chamber 63 and moved to the location adjacent to the discharge port 65, together with the introduced refrigerant gas for executing the capacity control, flows, via the capacity control valve 49 and the gas feed passageway 74, into the crank chamber 15. In other words, the gas feed passageway 74 in this embodiment functions also as the oil return passageway.

In view of the above, the second embodiment operates in a way similar to the first embodiment. In addition, during the operation near the minimum capacity of the compressor, the capacity control valve 49 functions to increase the degree of opening of the gas feed passageway 74, which functions also as the oil return passageway, thereby obtaining an increased amount of the lubricant directed from the oil separation chamber 63 to the crank chamber 15. As a result, a desired lubricated condition is obtained at various parts of the compressor where a sliding movement occurs, even during an operation near the minimum capacity of a reduced amount of the recirculated refrigerant. Furthermore, due to the fact that the gas feed passageway 74 functions also as the oil return passageway, the necessity of a separate part for constructing the oil return passageway is eliminated.

Further modifications of the present invention are possible without departing from the sprit of the present invention as explained hereinbelow.

Figure 5:
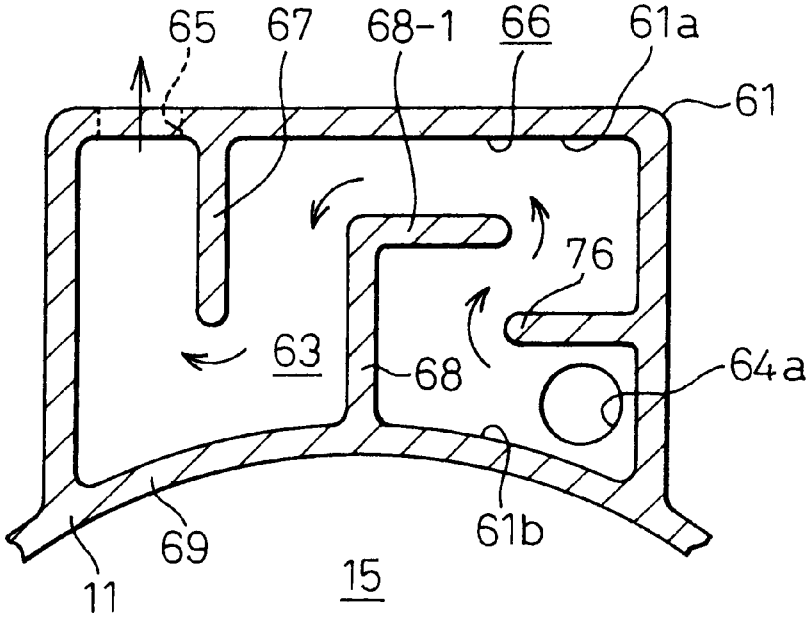
FIG. 5 is a cross sectional view of an oil separation chamber in a modification.

In the first embodiment, the directional change of the discharged refrigerant gas occurs in the vertical direction as shown in FIG. 2. However, the present invention is not limited to this operation. Namely, in a modification as shown in FIG. 5, the lower passageway forming plate 68 has, at its top end, a horizontally extending portion 68-1 and the oil separation part 61 or 62 has, at its inner side wall, an integrated horizontally extending part 76. As a result, a directional change in the flow of the discharged refrigerant gas also occurs in the lateral direction, i.e., a peripheral direction of the housing 11 to 13. As a result, a more complex curved passageway for the discharged refrigerant gas is created in the oil separation chamber 63, thereby increasing the oil separation performance.

Figure 6:
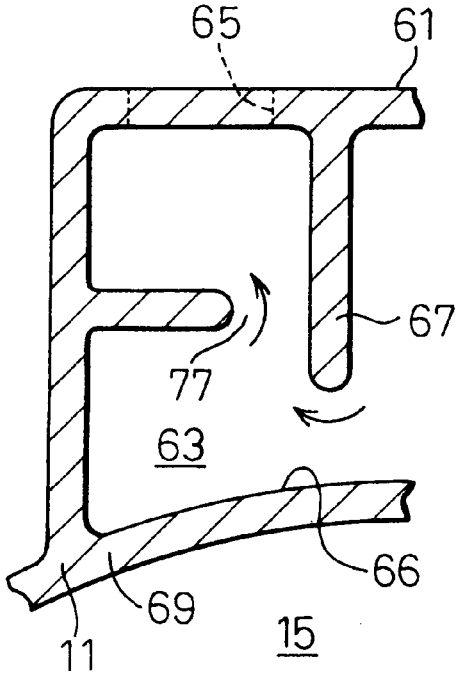
FIG. 6 is a cross sectional view of an oil separation chamber in another modification.

In a further modification as shown in FIG. 6, the first embodiment is modified in that, in the oil separation passageway 66, a throttle 77 is formed to reduce the flow area. As a result of this structure, a discontinuity in the flow area is created in the oil separation passageway, thereby enhancing the muffler function of the oil separation chamber 63.

Furthermore, in the shown embodiments, one of the front oil separation part 61 and rear oil separation part 62 may be merely constructed as a cap for closing the space inside the part. In other words, the oil separation chamber 63 may be formed only in the peripheral part of the front housing 11 or the cylinder block 12.

Furthermore, the front oil separation part 61 may be located in an outer shell of the cylinder block 12 and the rear side oil separation part 62 may be located in an outer shell of the rear housing 13, so that the separation chamber 63 may be formed between the cylinder block 12 and the rear housing 13.

Finally, the front oil separation part 61 may be located in the outer shell of the front housing 11 and the rear oil separation part 62 may be located in the outer shell of the rear housing 13, so that a central separating part may be formed in the shell of the cylinder block 12 so that spaces inside the front and rear oil separation parts 61 and 62 may be connected with each other. In other words, the separation chamber may be formed so that it extends from the front housing 11 to the rear housing 13.

We claim:

1. A compressor comprising:

a housing constructed by a plurality of housing members which are in connection with each other for creating a crank chamber;

an operating means in the crank chamber for causing a refrigerant gas to be sucked, compressed and discharged, and;

oil separators formed integrally at the outer portions of the housing members which are located adjacent to and in contact with each other in such a manner that an inner space in at least one of the oil separators is closed by the other oil separator so that a separation chamber for the discharged refrigerant gas is created;

said oil separator being integrally formed with passageway forming members, so that the separation chamber is partially divided in such a manner that, from an inlet to an outlet of the separation chamber, a serpentine shaped separation passageway for the discharged refrigerant gas is formed, while said separation chamber is in communication with the crank chamber via an oil return passageway;

wherein said housing is formed with a cylinder bore, to which a piston is slidably accommodated, said operating means comprise a drive shaft rotatably supported on the housing and a cam plate which is arranged in the crank chamber and supported by the drive shaft while a degree of an inclination of the cam plate with respect to an axis of the drive shaft is adjusted, so that an amount of the stroke of the piston is varied, thereby allowing the capacity to be varied;

and wherein in order to adjust the capacity, the pressure in the crank chamber is changed so that the pressure difference is changed between the crank chamber and the cylinder bore in which the piston located, and a capacity control valve is located in the oil passageway connecting the crank chamber with the oil separation chamber, so that the pressure at the crank chamber is adjusted by adjusting the degree of opening of the return passageway by the capacity control valve.

2. A compressor according to claim 1, wherein said separation chamber functions as a muffler for reducing the pressure pulsation of the discharged refrigerant gas.

3. A compressor according to claim 1, wherein said separation passageway is opened to the separation chamber at a location adjacent to an outlet of the separation chamber.

* * * * *